US008863410B2

(12) United States Patent
Schmid

(10) Patent No.: US 8,863,410 B2
(45) Date of Patent: Oct. 21, 2014

(54) CLEAT FOR A SHOE, SHOE SOLE WITH SUCH A CLEAT AND SHOE

(71) Applicant: Puma SE, Herzogenaurach (DE)

(72) Inventor: Peter Schmid, Central Hong Kong (HK)

(73) Assignee: Puma SE, Herzogenaurach (DE)

( * ) Notice: Subject to any disclaimer, the term of this patent is extended or adjusted under 35 U.S.C. 154(b) by 0 days.

(21) Appl. No.: 13/796,541

(22) Filed: Mar. 12, 2013

(65) Prior Publication Data

US 2013/0185960 A1 Jul. 25, 2013

Related U.S. Application Data

(62) Division of application No. 12/597,365, filed as application No. PCT/EP2008/000167 on Jan. 11, 2008, now abandoned.

(30) Foreign Application Priority Data

Apr. 24, 2007 (DE) ..... 20 2007 005 881 U

(51) Int. Cl.
*A43C 15/02* (2006.01)
*A43B 5/00* (2006.01)
*A43C 15/16* (2006.01)

(52) U.S. Cl.
CPC ..... *A43B 5/001* (2013.01); *A43C 15/161* (2013.01); *A43C 15/162* (2013.01)
USPC ..... 36/67 D; 36/127; 36/134

(58) Field of Classification Search
CPC ..... A43B 13/22; A43B 13/26; A43C 15/02; A43C 15/161–15/162; A43C 15/164–15/165; A43C 15/167
USPC ..... 36/67 A–67 D, 62, 64, 65, 127, 134
See application file for complete search history.

(56) References Cited

U.S. PATENT DOCUMENTS

| | | | | |
|---|---|---|---|---|
| 4,375,728 | A * | 3/1983 | Dassler | 36/32 R |
| D288,262 | S * | 2/1987 | Yokoishi | D2/962 |
| 4,962,596 | A | 10/1990 | Dufour | |
| 6,041,526 | A * | 3/2000 | Collins | 36/127 |
| 6,705,027 | B1 * | 3/2004 | Campbell | 36/127 |

(Continued)

FOREIGN PATENT DOCUMENTS

| | | |
|---|---|---|
| JP | 31-16644 | 10/1956 |
| JP | 47-17320 | 6/1972 |
| JP | 1-201202 A | 8/1989 |

OTHER PUBLICATIONS

Japanese Office Action for related application No. 2010-504467.

(Continued)

*Primary Examiner* — Jila M Mohandesi
(74) *Attorney, Agent, or Firm* — Lucas & Mercanti, LLP

(57) ABSTRACT

To improve the grip of the shoe at the ground, especially when playing golf, the shoe has a cleat with a cleat base body which can be connected to the sole and that at least one extension is arranged at the cleat base body which extends to the ground. The vertical projected area ($A_F$) of the end of the extension which is facing the ground is arranged at least partially, preferably completely, outside of the vertical projected area ($A_G$) of the cleat base body. The cleats are arranged on a carrier plate.

12 Claims, 5 Drawing Sheets

(56) References Cited

U.S. PATENT DOCUMENTS

| | | | | |
|---|---|---|---|---|
| 6,904,707 | B2 * | 6/2005 | McMullin | 36/127 |
| 7,386,948 | B2 * | 6/2008 | Sink | 36/127 |
| 7,654,013 | B2 * | 2/2010 | Savoie et al. | 36/67 D |
| 7,946,062 | B2 * | 5/2011 | Kelly | 36/127 |
| 8,215,035 | B2 * | 7/2012 | Mills et al. | 36/67 A |
| 2005/0217149 | A1 * | 10/2005 | Ho | 36/59 R |
| 2006/0090373 | A1 * | 5/2006 | Savoie et al. | 36/67 D |

OTHER PUBLICATIONS

English translation of D1.
English summary of D1.

* cited by examiner

CLEAT FOR A SHOE, SHOE SOLE WITH SUCH A CLEAT AND SHOE

This is a divisional application of U.S. patent application Ser. No. 12/597,365 filed Nov. 18, 2009, now abandoned which was a 371 of PCT/EP2008/000167 filed Jan. 11, 2008, which claimed priority of German application No. 10 2007 005 881.0 filed Apr. 24, 2007, the priority of each application is claimed and each application is incorporated by reference herein.

The invention relates to a cleat for a shoe, especially for a golf shoe, which cleat can be attached to the bottom side of a sole. Furthermore, the invention relates to a shoe sole with such a cleat as well as to a shoe with such a sole.

Shoes having cleats are well known in the state of the art. Here, not only cleats which are rotationally symmetric are used which is the usual application. Also, the cleats which are fixed at the bottom side of a shoe sole can have asymmetric forms.

WO 00/15068 A1 shows cleats which are anchored at the bottom side of a shoe sole, wherein the cleats are substantially triangular in a vertical projection, amongst others. FR 2 818 876 A1 shows cleats having an elongated shape.

Here, the cleats extend mostly in vertical direction with their longitudinal axis, i.e. perpendicular to the surface of the sole.

DE 30 32 268 A1 shows cleats which are also arranged angular (in the side area of the sole), i.e. they are directed to the side. A similar solution shows DE 28 28 561 A1.

For some applications it is desirable that the basic effect of the cleat shoe remains in force but that a specific resistance in a defined direction is established against slipping of the foot on the ground to the side. A typical example is a golf shoe which must have a specific grip on the ground and especially on grass due to the kinetics during a hit with a golf club.

Thus, it is an object of the invention to propose a cleat, a sole supplied with such a cleat and a shoe supplied with the sole, especially a golf shoe, which is characterized by an improved grip on the ground, wherein the specific kinetics of golf should be taken into account. The forces which occur here should be transmitted selectively into the required directions to provide an optimal hold for the foot of the golf player on the ground. Furthermore, it is aimed that such a cleat shoe can be produced in an especial economical way.

The solution of this object by the invention is characterized in that the cleat has a cleat base body which can be connected with the sole and that at least one extension is arranged at the cleat base body which extends to the ground, wherein the vertical projected area of the end of the extension which is facing the ground is arranged at least partially, preferably completely, outside of the vertical projected area of the cleat base body.

Thus, it can be said that at the cleat base body at least one extension is arranged, which extends to the ground, wherein the extension leaves the vertical projected area of the cleat base body with its end which is facing the ground. Thus, the proposed cleat is characterized by the fact that beside the cleat base body as such an extension is arranged having a defined alignment, wherein the extension leaves the vertical projected area of the cleat base body, so that a specifically good side hold of the cleat at the ground is established.

Preferably, the extension has an elongated shape with a longitudinal axis. The longitudinal axis of the extension and the vertical direction include preferably an angle between 20° and 60°, specifically an angle between 30° and 50°.

According to an embodiment the extension has a substantially rectangular shape at least in sections in a cross section perpendicular to its longitudinal axis.

The cleat base body and the at least one extension are preferably formed integrally as an injection moulded part. The cleat base body and the at least one extension consist preferably of thermoplastic elastomer material on a urethane basis (TPU).

The cleat base body has according to a further development a substantially hemispherical shape. To make it possible to firmly fix the cleat in the sole, an embodiment of the invention suggests that the cleat base body comprises anchor elements for anchorage in the sole. These can be cylinders which extend in vertical direction and which are coated by the material of the sole. Preferably a plurality of cylinders is arranged around the circumference of the cleat base body at its end facing the sole. Preferably it is further suggested that the anchor elements are arranged at a disk which in turn is connected with the cleat base body.

For a specific economical production a further preferred development suggests that the cleat is part of a cleat element which has a carrier plate on which at least two cleats are arranged.

There, the at least two cleats and the carrier plate are preferably formed integrally as an injection moulded part.

A specifically beneficial embodiment of the cleat element, by which an easy and fast and thus economic implementation of a shoe sole with cleats becomes possible, is characterized in that three cleats are arranged on the carrier plate; there, the carrier plate has preferably but not mandatory the shape of an equilateral triangle.

Furthermore, the carrier plate can have a recess which is arranged between the cleats.

The extensions of the different cleats on the carrier plate can all be directed in the same direction; they can also be directed in different directions.

The proposed shoe sole has at least one cleat of the mentioned kind. There, it is preferably proposed that at least two cleats are arranged on the sole, wherein the extensions of the at least two cleats are directed in at least two different directions.

If the beneficial embodiment with the cleat elements (with several cleats per element) is used it can be provided that the carrier plate is glued on the sole base body. An alternative to this solution suggests that the carrier plate is fixed on the sole base body by welding. A further and very beneficial, because economical, embodiment suggests that the carrier plate is coated by the material of the sole by an injection moulding process.

An alternative embodiment suggests that the cleats at the carrier plate and/or the carrier plate at the sole are arranged detachably, for example and preferably by means of a screw connection. By doing so a substitution of unusable cleats and cleat elements respectively becomes possible.

The invention is used with specific advantages for a golf shoe.

The material of the cleat and especially for its extension is preferably chosen and the extension is dimensioned in such a way that its deformation under load of the wearer of the shoe remains small, so that the extension finds a hold in the ground as good as possible by penetration into the ground.

In the drawing an embodiment of the invention is shown.

Figure 4:
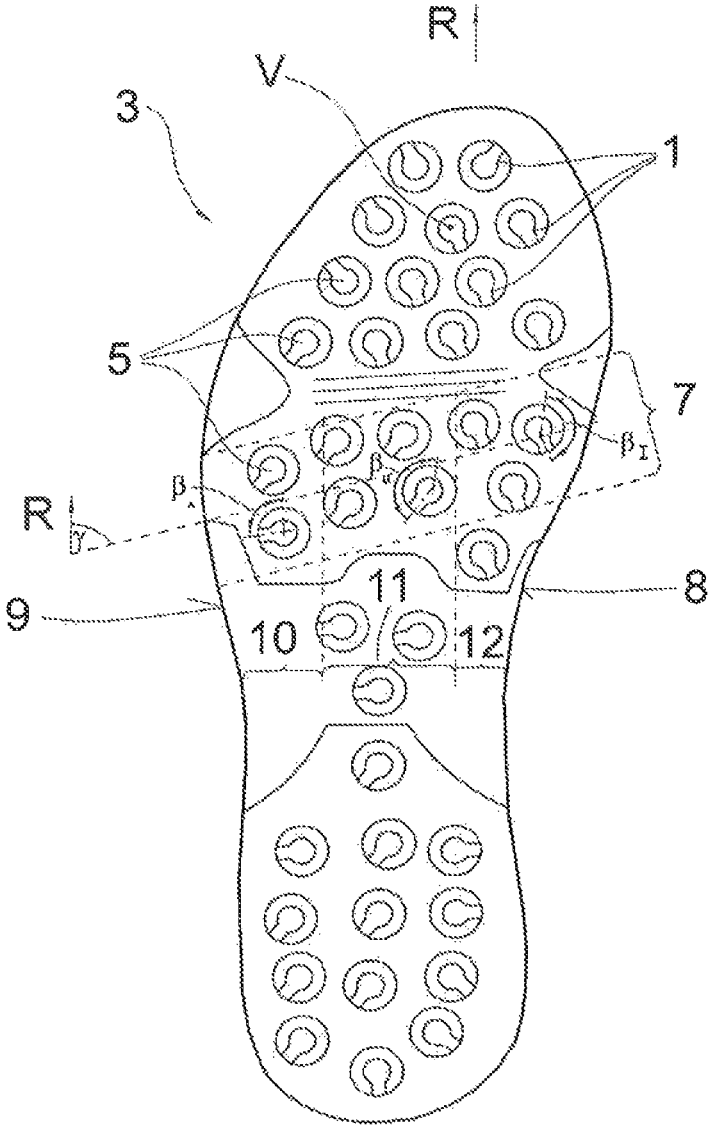
Figure 5:
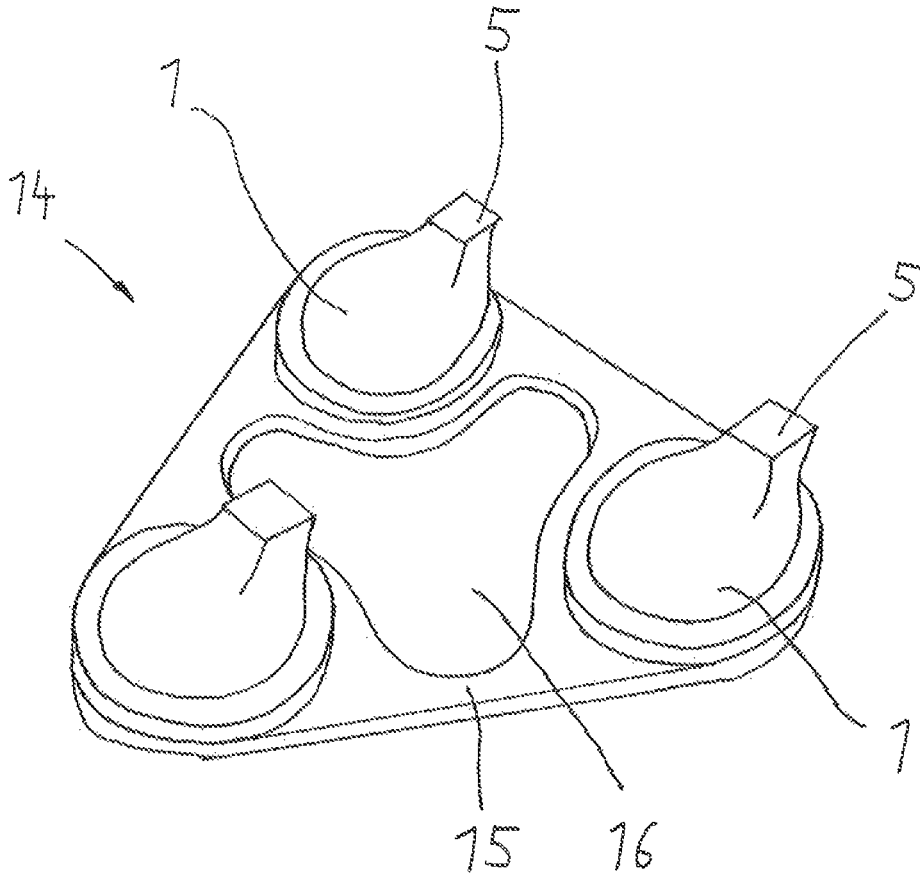
Figure 6:
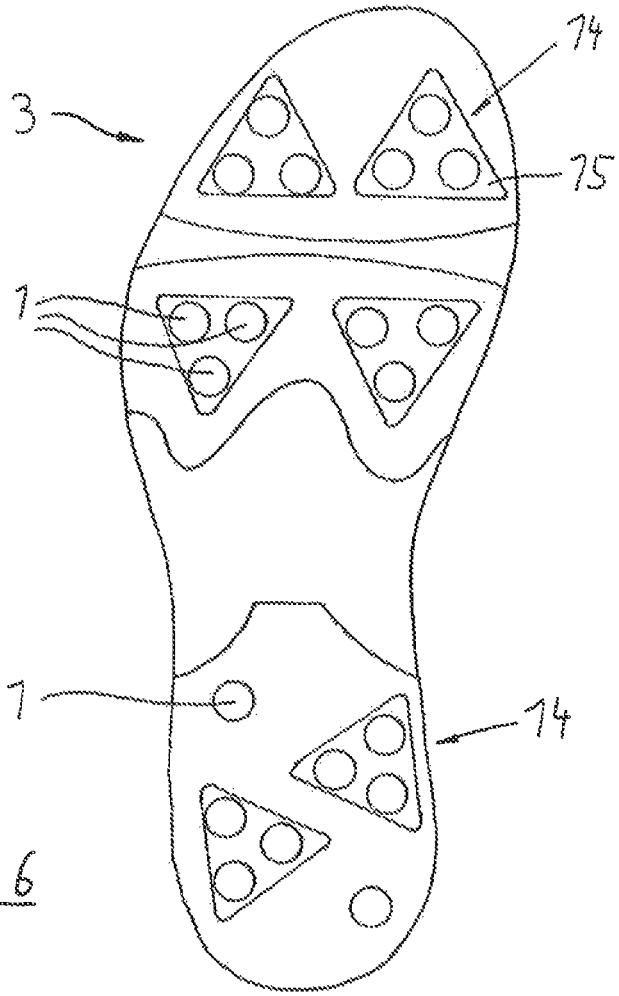
Figure 7:
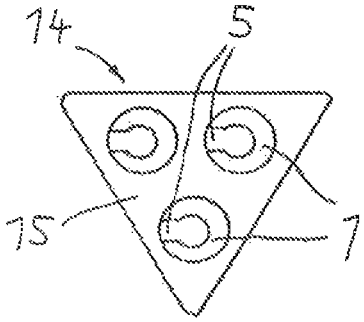
Figure 8:
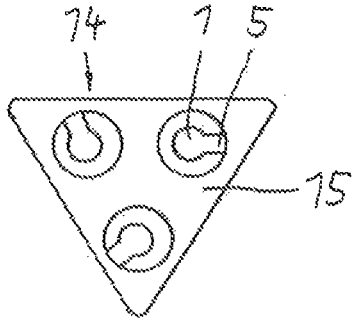

FIG. 4 shows the top plan view of the bottom side of a sole of a golf shoe, which is supplied with a plurality of cleats, FIG. 5 shows a perspective view of a cleat element with three cleats, FIG. 6 shows the top plan view of the bottom side of a sole of a golf shoe, which is here supplied with a plurality of cleat elements according to FIG. 5, FIG. 7 shows the top plan view of a cleat element with three cleats according to a first embodiment and FIG. 8 shows the top plan view of a cleat element with three cleats according to an alternative second embodiment.

Figures 1, 3:
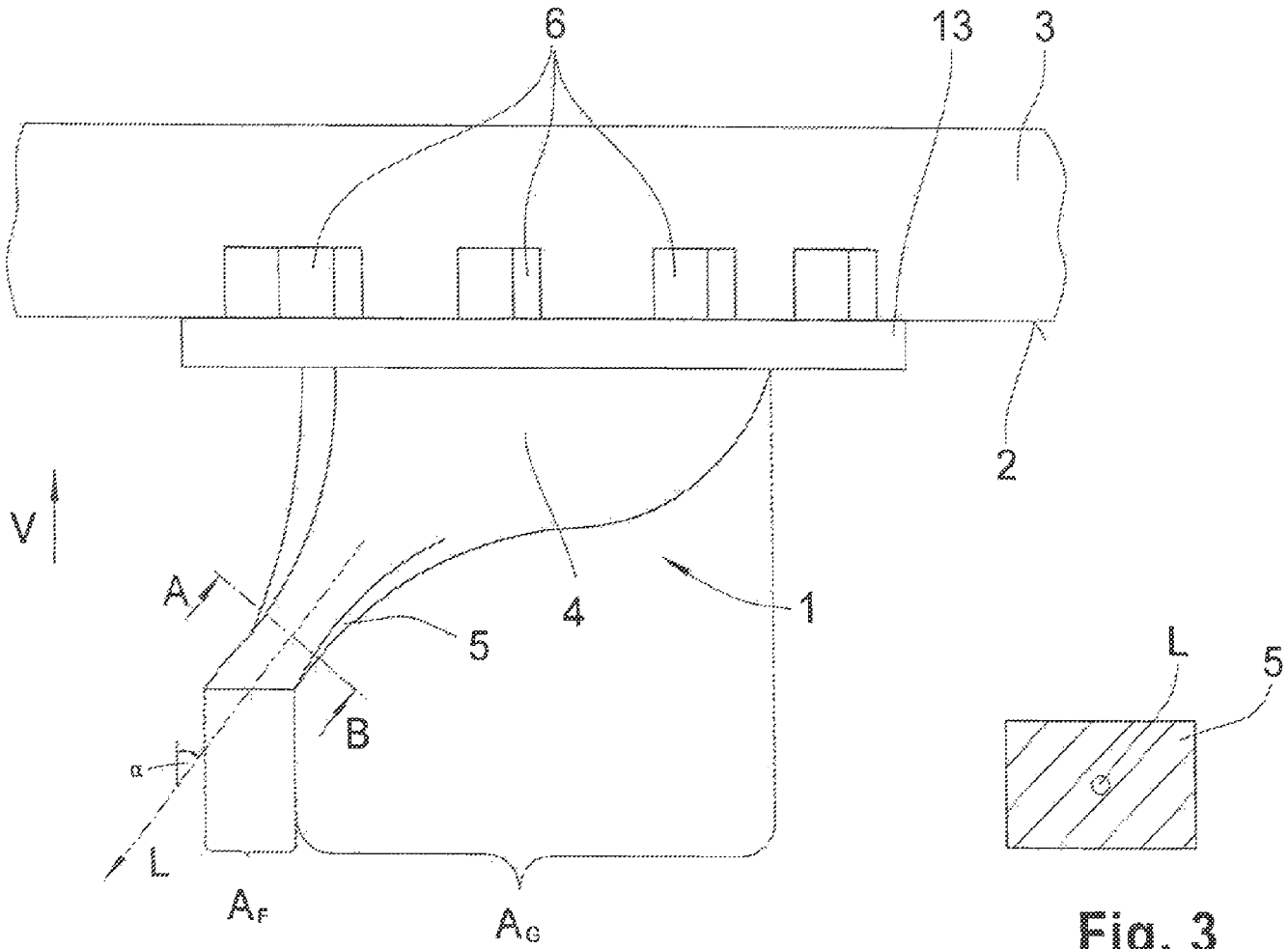
FIG. 1 shows a side view of a cleat, which is anchored in a sole.
FIG. 3 shows the cross section A-B according to FIG. 1.
Figure 2:
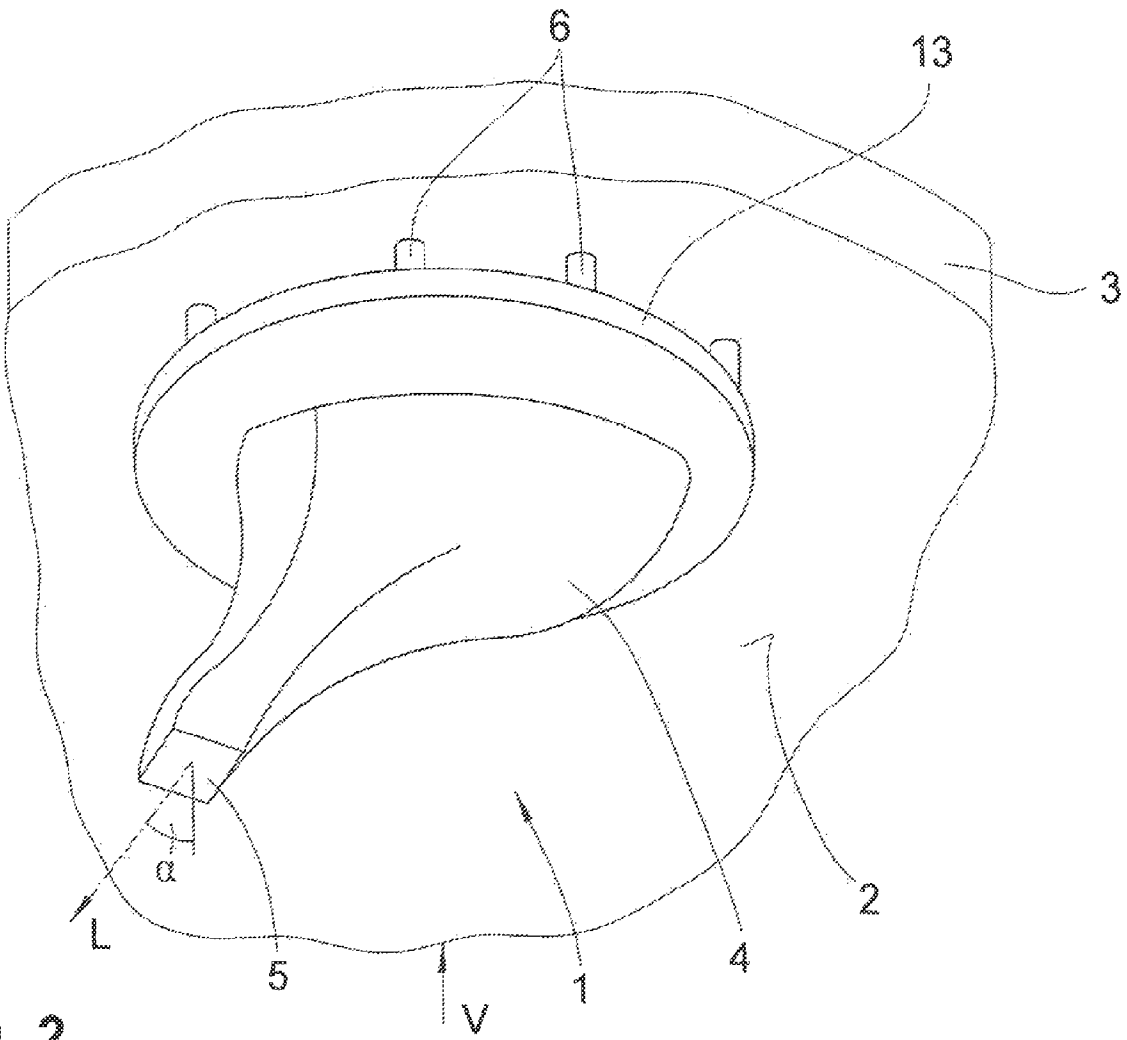
FIG. 2 shows a perspective view of the cleat according to FIG. 1.

In FIG. 1 and FIG. 2 a cleat 1 is depicted, which is anchored at the bottom side 2 of a sole 3 of a shoe. The cleat 1 has a cleat base body 4 which has a substantially hemispherical shape. If the cleat base body 4 is regarded—see FIG. 1—it can be observed that it defines a projected area $A_G$, which becomes apparent when regarded from vertical direction V; this is circular shaped in the embodiment.

The safe anchoring of the cleat 1 in the sole 3 is effected by a plurality of anchor elements 6. These are implemented as substantial cylindrical pins, which extend in vertical direction V and which are coated by injection moulding during the production of the shoe and the sole respectively. A clear abutment of the cleat 1 at the sole 3 is accomplished by a disk 13, which bears the anchor elements 6 and is connected in turn with the cleat base body 4. The cleat base body 4, the disk 13 and the anchor elements 6 are made as an integrated part.

It is important, that at the cleat base body 4 at least one extension 5 is arranged which extends toward the ground. Thereby, the extension 5 leaves with its end which is facing the ground—as can be seen best in FIG. 1—the vertical projected area $A_G$ of the cleat base body 4. I.e. the vertical projected area $A_F$ of the end of the extension 5 facing the ground (which is rectangular in the embodiment) lies at least partially, preferably completely (as shown in the embodiment) outside the vertical projected area $A_G$ of the cleat base body 4.

There, the extension 5 is rod-shaped, so that a longitudinal axis L is defined, along which the extension 5 extends. This longitudinal axis L and the vertical direction include an angle $\alpha$, which is approximately 40° in the embodiment.

As can be seen in FIG. 3 the extension has a substantial rectangular cross section (see cross section A-B according to FIG. 1).

With the proposed design it becomes possible to establish in addition to the known cleat-effect—caused by the cleat base body 4—a specific side hold of the cleat 1 at the ground, what is established by the extension 5.

In this regard a possible embodiment is shown for a golf shoe in FIG. 4. Here, the sole 3 of the golf shoe can be seen from the bottom side, on which a plurality of cleats 1 is fixed.

Each cleat 1 has an extension 5, which extends as shown in FIG. 1. The projection on the ground delivers the alignment of the extension 5, which can be seen in FIG. 4. It can be seen that the extensions 5 are aligned in a different manner, i.e. they are directed to different sides. Namely it can be seen, that an angle $\beta$ can be defined which is included between the projection of the extension 5 on the ground and the longitudinal axis R of the shoe. This is marked for the middle sole region in FIG. 4 for three cleats 1.

In the embodiment according to FIG. 4 it is provided that at least one of the shoes of a pair of shoes is supplied with cleats 1 along an imaginary band 7, which extends across the width of the sole 3 from the sole inner side 8 to the sole outer side 9.

Its extension 5 in the outer sole region 10 is arranged under an angle $\beta_A$ between 60° and 135° to the longitudinal axis R of the shoe to the outer side. In the middle sole region 11 the extension 5 is aligned under an angle $\beta_M$ between 135° and 225° to the longitudinal axis R of the shoe rearwards. Finally, in the inner sole region 12 the extension 5 is aligned under an angle $\beta_1$ between 90° and 180° to the longitudinal axis R of the shoe to the inner side.

Thereby, the imaginary band 7 extends from the sole outer side 9 under an angle $\gamma$ between 30° and 90°, preferably between 40° and 50°, to the longitudinal axis R of the shoe in the direction to the sole inner side 8. Furthermore, the imaginary band 7 begins at the sole outer side 9 approximately in the middle between the front and rear end of the sole 3. As can be seen, four till six cleats 1 are arranged side by side along the imaginary band 7.

The adjustment of the cleats 1 in the explained manner has the advantage, that the forces due to the kinetics during the hit of a golf ball, which must be transmitted via the shoe to the ground, can be transferred in an optimal way. So, especially when playing golf an improved hold of the shoe at the ground is established.

The adjustment of the cleats 1 in the explained manner takes into account that during the hit of a ball with a golf club along the process of the hit forces must be transferred in different manner from the golf club via the player and his legs to the ground. When using the alignment of the cleats 1 with its extensions 5 especially within the imaginary band 7 optimal results are achieved in this regard.

In the embodiments in each case only a single extension 5 is arranged at the cleat base body 4. But also two or three extensions 5 can be provided which then extend star-shaped to one side direction of the cleat 1.

The two soles of a pair of shoes must not necessarily be equipped with cleats in a mirrored way. It can also be reasonable that the two shoes are equipped with cleats in different manner.

To equip the sole of the shoe in an easy and economical way with cleats in the described manner, the invention furthermore suggests a solution as can be seen in FIGS. 5 till 8.

In FIG. 5 a cleat element 14 is depicted which can be manufactured as a separate part, before it is connected with the sole 3. Here, the cleat element 14 has three cleats 1 which have respective extensions 5. The cleats 1 are connected with a carrier plate 15, i.e. presently cleats 1 and carrier plate 15 are produced by a common injection moulding process.

To save weight and material the solution according to FIG. 5 provides that the carrier plate 15 has a recess 16.

As can be seen from FIG. 6 the sole 3 is supplied with a number—here: six—of cleat elements 14, wherein it is possible that beside them also single cleats 1 are arranged at the sole 3.

FIGS. 7 and 8 show variants of the design of the cleat elements 14. The cleat elements 14 are supplied with three cleats 1 respectively. In FIG. 7 it can be seen that the extensions 5 are all directed to the same direction. According to FIG. 8 this is not the case; here, the extensions 5 are directed in different directions.

The invention disclosed herein can be defined as follows:

1. Cleat (1) for a shoe, especially for a golf shoe, which cleat can be attached to the bottom side (2) of a sole (3), characterized in that
   the cleat (1) has a cleat base body (4) which can be connected with the sole (3) and that at least one extension (5) is arranged at the cleat base body (4) which extends to the ground, wherein the vertical projected area ($A_F$) of the end of the extension (5) which is facing the ground is arranged at least partially, preferably completely, outside of the vertical projected area ($A_G$) of the cleat base body (4).

2. Cleat according to 1 above, characterized in that the extension (5) has an elongated shape with a longitudinal axis (L).
3. Cleat according to 2 above, characterized in that the longitudinal axis (L) of the extension (5) and the vertical direction (V) include an angle ($\alpha$) between 20° and 60°.
4. Cleat according to 3 above, characterized in that the angle (o) is between 30° and 50°.
5. Cleat according to one of 1 to 4 above, characterized in that the extension (5) has a substantially rectangular shape at least in sections in a cross section perpendicular to its longitudinal axis (L).
6. Cleat according to one of 1 to 5 above, characterized in that the cleat base body (4) and the at least one extension (5) are formed integrally as an injection moulded part.
7. Cleat according to 6 above, characterized in that the cleat base body (4) and the at least one extension (5) consist of thermoplastic elastomer material on a urethane basis (TPU).
8. Cleat according to one of 1 to 7 above, characterized in that the cleat base body (4) has a substantially hemispherical shape.
9. Cleat according to one of 1 to 8 above, characterized in that the cleat base body (4) comprises anchor elements (6) for anchorage in the sole (3).
10. Cleat according to 9 above, characterized in that the anchor elements (6) are cylinders which extend in vertical direction (V) and which are coated by the material of the sole (3).
11. Cleat according to 10 above, characterized in that a plurality of cylinders (6) is arranged around the circumference of the cleat base body (4) at its end facing the sole (3).
12. Cleat according to one of 9 to 11 above, characterized in that the anchor elements (6) are arranged at a disk (13) which in turn is connected with the cleat base body (4).
13. Cleat according to one of 1 to 12 above, characterized in that it is part of a cleat element (14) which has a carrier plate (15) on which at least two cleats (1) are arranged.
14. Cleat according to 13 above, characterized in that the at least two cleats (1) and the carrier plate (15) are formed integrally as an injection moulded part.
15. Cleat according to 13 or 14 above, characterized in that three cleats (1) are arranged on the carrier plate (15), wherein the carrier plate (15) has the shape of a preferably equilateral triangle.
16. Cleat according to one of 13 to 15 above, characterized in that the carrier plate (15) has a recess (16) which is arranged between the cleats (1).
17. Cleat according to one of 13 to 16 above, characterized in that the extensions (5) of the cleats (1) all are directed in the same direction.
18. Cleat according to one of 13 to 16 above, characterized in that the extensions (5) of the cleats (1) are directed in different directions.
19. Cleat according to 13 above, characterized in that it is arranged detachably at the or on the carrier plate (15), especially by means of a screw connection.
20. Shoe sole (3) with at least one cleat (1) according to one of 1 to 19 above.
21. Shoe sole (3) according to 20 above, characterized in that at least two cleats (1) are arranged on it, wherein the extensions (5) of the at least two cleats (1) are directed in at least two different directions.
22. Shoe sole (3) according to one of claims 13 to 19 and 20 above, characterized in that the carrier plate (15) is glued on the sole base body.
23. Shoe sole (3) according to one of claims 13 to 19 and 20 above, characterized in that the carrier plate (15) is fixed on the sole base body by welding.
24. Shoe sole (3) according to one of 13 to 19 and 20 above, characterized in that the carrier plate (15) is coated by the material of the sole (3) by an injection moulding process.
25. Shoe sole (3) according to one of 13 to 19 and 20 above, characterized in that the carrier plate (15) is detachably arranged at the or on the sole base body, especially by means of a screw connection.
26. Shoe, especially golf shoe, with a sole (3) according to one of 20 to 25 above.

REFERENCE NUMERALS

1 Cleat
2 Bottom side
3 Sole
4 Cleat base body
5 Extension
6 Anchor element
7 Imaginary band
8 Sole inner side
9 Sole outer side
10 Outer sole region
11 Middle sole region
12 Inner sole region
13 Disk
14 Cleat element
15 Carrier plate
16 Recess
$A_G$ Vertical projected area of the cleat base body
$A_F$ Vertical projected area of the end of the extension
L Longitudinal axis
$\alpha$ Angle
V Vertical direction
R Longitudinal axis of the shoe
$\beta_A$ Angle
$\beta_M$ Angle
$\beta_1$ Angle
$\gamma$ Angle

The invention claimed is:

1. A cleat element for attachment to a bottom side of a sole of a shoe, the cleat element comprising:

a carrier plate, and at least two cleats arranged on the carrier plate, wherein each of the at least two cleats comprises:

a cleat base body attached to the carrier plate, the cleat base body substantially hemispherical in shape with a hemispherical surface which extends vertically downward from the carrier plate, wherein a cross section of the hemispherical surface taken between first and second points defining a greatest width of the hemispherical surface and at an angle perpendicular to the sole of the shoe defines a continuous curve from the first point to the second point, the cleat base body having a vertically projected area;

a single extension extending vertically downward from the hemispherical surface of the cleat base body, a distal end of the extension having a vertically projected area, and the vertically projected area of the extension being at least partially outside the vertically projected area of cleat base body.

2. The cleat element of claim 1, wherein the extension has an elongated shape with a longitudinal axis.

3. The cleat element of claim 2, wherein the longitudinal axis of the extension and the vertical direction form an angle between 20° and 60°.

4. The cleat element of claim 1, wherein the extension has a substantially rectangular shape in a cross section perpendicular to its longitudinal axis at the distal end of the extension.

5. The cleat element of claim 1, wherein the cleat base body and the extension are formed integrally as an injection moulded part.

6. The cleat element of claim 1, wherein the at least two cleats and the carrier plate are formed integrally as an injection moulded part.

7. The cleat element of claim 6, wherein three of the cleats are arranged on the carrier plate, and the carrier plate has the shape of an equilateral triangle.

8. The cleat element of claim 1, wherein the carrier plate has a recess which is arranged between the cleats.

9. A shoe sole comprising:

a sole, a base body; and at least one cleat element according to claim 1.

10. The cleat element of claim 9, wherein the carrier plate is glued on the sole, the carrier plate is fixed on the sole by welding, or the carrier plate is coated by the material of the sole by an injection moulding process.

11. The shoe sole according to claim 10, wherein the carrier plate is detachably arranged at the or on the sole base body by means of a screw connection.

12. A golf shoe, with the shoe sole according to claim 9.

* * * * *